United States Patent [19]

Black

[11] Patent Number: 4,761,905

[45] Date of Patent: Aug. 9, 1988

[54] SCANNED ELECTROMECHANICAL DISPLAY

[76] Inventor: Fred M. Black, 109 Kemp Rd. East, Greensboro, N.C. 27410

[21] Appl. No.: 913,536

[22] Filed: Sep. 30, 1986

[51] Int. Cl.[4] ..... G09F 3/04

[52] U.S. Cl. ..... 40/447; 40/463; 340/764; 340/809; 340/815.24; 340/815.26

[58] Field of Search ..... 40/447, 463, 446, 449, 40/452, 547, 470, 473, 476, 451, 466, 487; 340/815.26, 815.27, 815.2, 815.24, 764, 763, 765, 783, 757, 703, 706, 809, 810, 815.31

[56] References Cited

U.S. PATENT DOCUMENTS

| | | | |
|---|---|---|---|
| 1,923,523 | 8/1933 | Whitney | 340/764 |
| 3,267,595 | 8/1966 | Levy et al. | 340/764 |
| 3,375,512 | 3/1968 | Watkins et al. | 340/815.26 |
| 3,949,392 | 4/1976 | Caritato | 340/706 |
| 4,266,207 | 8/1984 | Salam | 340/815.27 |
| 4,417,241 | 11/1983 | Wakatake | 340/764 |
| 4,533,912 | 8/1985 | Gál et al. | 340/815.27 |

FOREIGN PATENT DOCUMENTS

| | | | |
|---|---|---|---|
| 1931186 | 12/1977 | Fed. Rep. of Germany | 40/449 |
| 2540266 | 8/1984 | France | 340/815.26 |

*Primary Examiner*—Robert P. Swiatek
*Assistant Examiner*—J. Hakomaki
*Attorney, Agent, or Firm*—Darby & Darby

[57] ABSTRACT

A display panel includes a matrix of rows and columns of individually rotatable cube-like display elements each having four display faces, with opposing faces being identical in color or reflectivity, for example, and adjacent faces which are 90° to one another each being of opposite color or reflectivity, for example. A trigger arm protruding from a center portion of an upper or a lower edge of each display face is selectively contacted by a trigger pin of a solenoid mounted upon and moved past the cube via a carriage mechanism for rotating the display element at least 45°, whereafter the display element continues to rotate an additional 45° in the same direction, and is assisted in completing the rotation by a magnetic detent mechanism, which detents the display element into its new position after completion of rotation, for displaying a new face of the display element at the front of the display matrix.

15 Claims, 3 Drawing Sheets

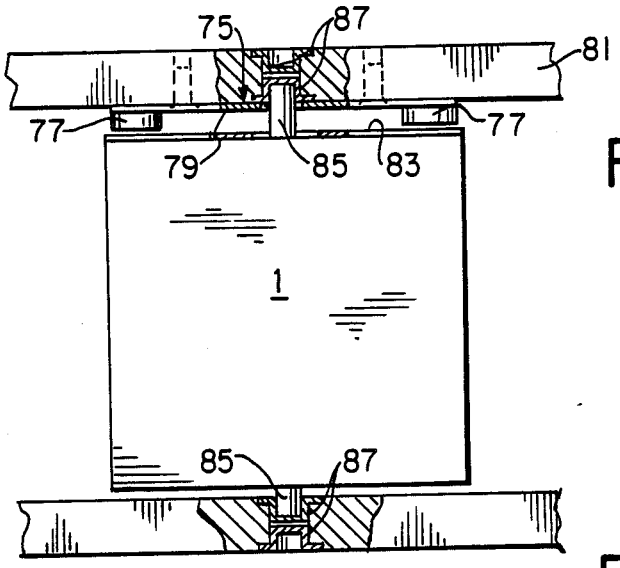
FIG. 8
FIG. 9A
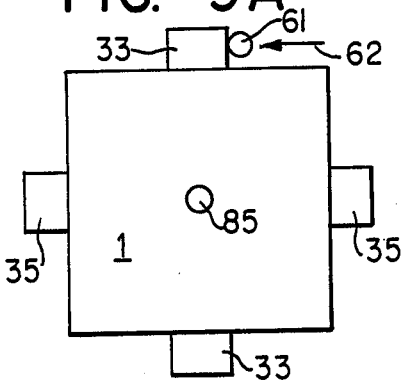
FIG. 9B
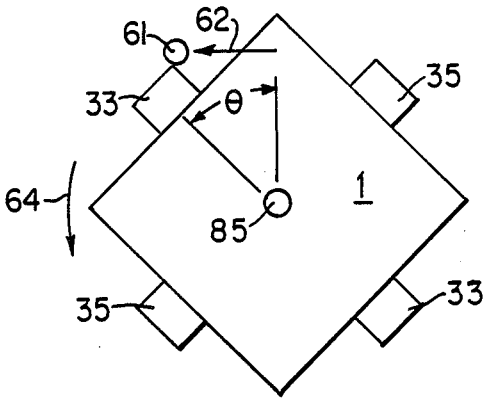
FIG. 10A
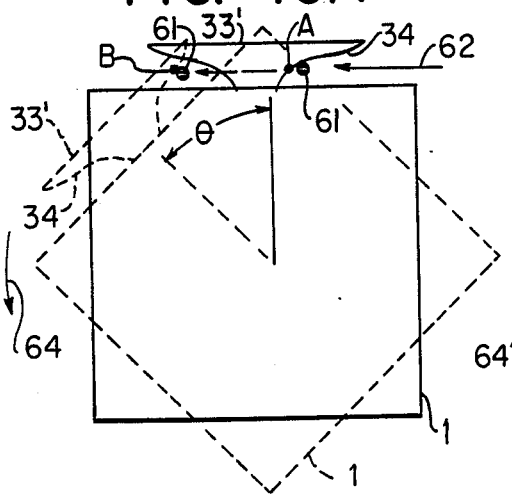
FIG. 10B
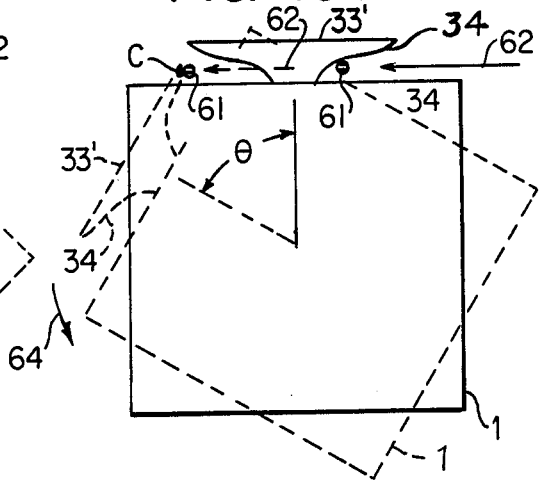

SCANNED ELECTROMECHANICAL DISPLAY

FIELD OF THE PRESENT INVENTION

The present invention relates to a display for sign for displaying alphanumeric and/or graphical information, either passively or in animated fashion, and more particularly relates to a matrix of columns and rows of like display elements that can be remotely changed from one display state to another, for changing the display from one arrangement of the elements to another.

BACKGROUND OF THE INVENTION

Many different types of mechanical, electromechanical, and electronic display devices are known in the Prior Art. For example, Wakatake U.S. Pat. No. 4,177,458, a display panel, is shown to include a plurality of display elements that are rotatable in a vertical plane. The elements are formed from plate-like or four-cornered block members having two or four display surfaces of different colors and include one or three magnetic pieces, respectively. Up to three electromagnets are energized for permitting the selection of a particular face of a given display element be rotated to the display side of the display panel. In this manner a desired pattern can be displayed. In a later Wakatake U.S. Pat. No. 4,264,906, similar display elements are shown that have display surfaces of different colors, performing displays of desired characters or patterns in the display side of the display panel.

In Bergamin; U.S. Pat. No. 4,161,832, an electromechanical digital indicator for displaying numerical information is disclosed, in which angular movements of seven movable segments are combined with the action of a block in the shape of an eight and made of a transparent and light-channeling plastic material, to display selected figures from zero to nine in solid lines rather than in segmented form. Fluorescent layers on the bottom wall of the block are included for displaying the numerals under conditions of either direct or indirect lighting, or in darkness. Also, internal illumination can be provided on the interior portion of the indicator box.

In Andersen U.S. Pat. No. 4,091,382, a display system is disclosed that is made up of a plurality of display units each including a thin, pivotally-mounted vane 20 movable by electrostatic forces between an upright and a horizontal position, for selectively providing a desired display. Also, in Winrow U.S. Pat. No. 3,975,728, an electromagnetic display is taught that includes a plurality of display elements each including a disc that is pivotally mounted on an axis parallel to the mean plane of the display, whereby electromagnetic means are used to rotate the disc for providing a desired display. In Hart U.S. Pat. No. 3,685,040, a display apparatus including a plurality of horizontally extending panels interconnected to form an endless belt having a plurality of light passages, wherein each light passage includes a closure mechanism for selectively opening or closing the light passageway, whereby lamps positioned on the nondisplay side of the belt are selectively permitted to shine light through the passages passing in front of the lamps for displaying desired information on the display side of the apparatus area. Another display device for covering or uncovering a display element includes shutter disc or shutter blades electromechanically operable to cover or uncover a hole for displaying information, as taught in Salam U.S. Pat. No. 3,562,938.

In Levy et al. U.S. Pat. No. 3,267,595, a display unit is disclosed that can be provided with a plurality of different types of display elements and triggering mechanisms for moving the display elements to change the display. In one embodiment, Levy et al. includes a moving belt of rows and columns of rotatable rectangular-like display elements, whereby for each row of display elements, a solenoid-operated trigger finger is selectively activated for flipping over (rotating by 180° selective ones of the elements for changing the information being displayed. A mechanical cam mechanism 24 (see FIG. 6) is used to hold a given display element 23 in appropriate alignment in the display for displaying information through appropriate positioning of the various ones of the elements 23 in the matrix. In FIG. 8, a control system is shown for controlling selective activation of the various electromagnetic triggers for selectively flipping the display elements 23. In another embodiment, triangular display elements are shown in FIG. 9 for providing three-faced elements, and are used in combination with a pair of solenoid-operated trigger pins to rotate selected ones of the triangles from one display position to another. Four-faced display elements 60, as shown in FIG. 11, represent another embodiment which requires three solenoid-operated "triggers" for selectively rotating a given four-faced element or block, and three "reset fingers" are required for resetting the elements. Each element of Levy's four-faced elements appear to be cube-like, and to have four unique faces. Also, Levy rotates the belt of display elements past stationery solenoid-operated triggers for changing the elements rotational orientation, to change a given display. Another embodiment of Levy et al. (see FIG. 26) shows a fixed matrix of display elements 160, with a carriage mechanism provided at the back of the display 160, for moving a plurality of solenoid-operated fingers back and forth across the back of the display element, for selectively flipping various ones of the display elements 180° for providing a desired display on the front of the display unit. As shown in FIG. 27, the elements 161 each include two lugs for providing automatic resetting, whereby when a given one of the lugs 175 or 176 contact an arm 171 of a solenoid 172, the element is flipped 180° to change the face of the element being presented on the display side of the display unit.

A display apparatus using selectively rotatable spheres mounted on rods, whereby half of a given sphere is one color, and the other half another color. The spheres are selectively rotated to display information in a matrix of two colors. Also, in Roberts U.S. Pat. No. 4,139,841, an electromagnetic display board is taught having a plurality of holes arranged in rows and columns, sources of light behind the holes, and electromagnetically-operated shutters for opening and closing each hole for displaying desired information.

SUMMARY OF THE INVENTION

In a preferred embodiment of the invention, a display apparatus is provided comprising four-sided display elements having two unique faces, wherein opposing faces are identical, for example, the same color, whereas the other two opposing faces are identical and of a different color than the former. The display elements are arranged in a matrix of rows and columns, with each element having trigger arms mounted on an edge of each face, interacting with triggering means mounted on a carriage mechanism for moving the triggering means back and forth on the non-display side of the apparatus, whereby the triggering means is operable for selectively rotating various ones of the elements during a given pass of a carriage for presenting a desired display, and changing the display by rotation of selective ones of the elements of only 90°. Magnetic detent means of the system complete rotation of a given display element and provide detenting for holding the display element in place once it has rotated 90°, thereby ensuring that the desired face of the display element is properly oriented in the matrix.

BRIEF DESCRIPTION OF THE DRAWINGS

In the drawing, wherein like items are indicated by the same reference number, wherein:

FIGS. 6A, 6B, 7, and 8, show a top view of a detented display element, a top view of the element rotated about 45° from its detented position, a pictorial view of an element, and a side view of the element, respectively, with each view showing the respective element incorporating a magnetic detent mechanism for the preferred embodiment of the invention;

FIGS. 9A and 9B show trigger arms and the operation thereof for rotating a display element in one embodiment of the invention; and FIGS. 10A and 10B show a trigger arm design for the preferred embodiment of the invention, and the operation thereof.

DESCRIPTION OF THE PREFERRED EMBODIMENT OF THE INVENTION

Figure 1:
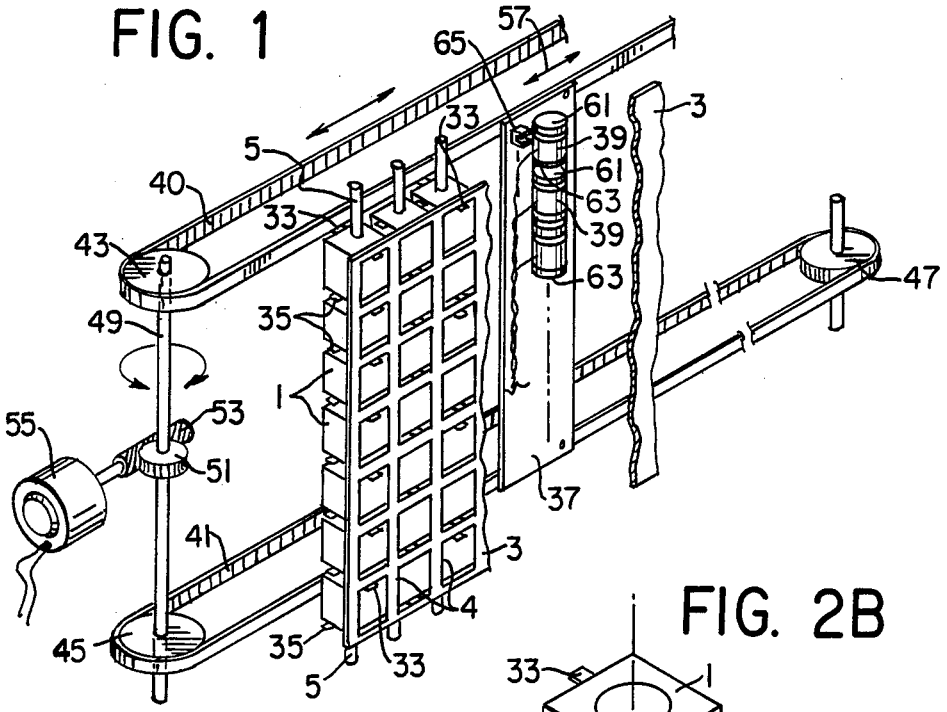
FIG. 1 is a fragmented cut-away pictorial diagram of one embodiment of the invention.

With reference to FIG. 1, one embodiment of the invention includes a matrix of rotatable four-state elements 1 arranged in rows and columns within a frame 3 having apertures 4 associated with each element 1. In this example, each column of elements 1 are rotatably mounted upon a stationery center shaft 5, as shown. The elements 1 can be rectangularly, cylindrically, or spherically shaped. Each element 1 contains two pairs of opposing display faces that can be made identically non-reflective or opaque and in quadrature, the other pair opposing display faces may be reflective or transparent/translucent, for example. Also, each pair of opposing faces may be of the same color, but of a different color from that of the other pair of opposing faces of the element 1. In yet another arrangement, each one of faces can be made different, for providing an element 1 with four unique faces.

Figure 2B:
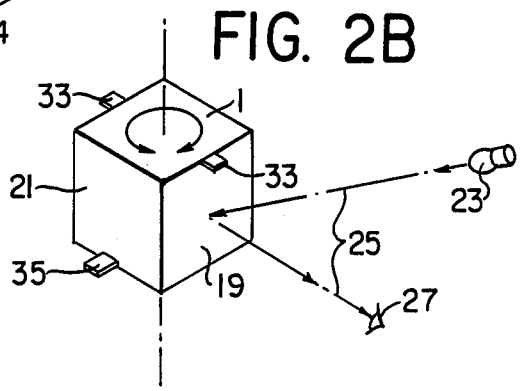
FIGS. 2A and 2B show display elements of two different embodiments of the invention, respectively.
Figure 2A:
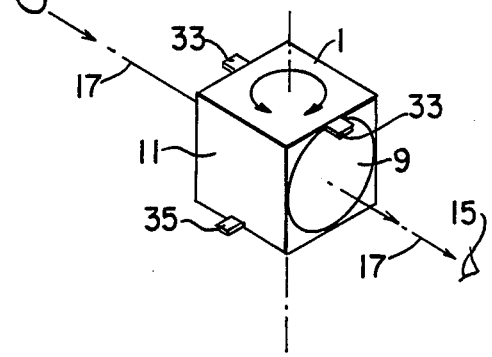
Figure 3:
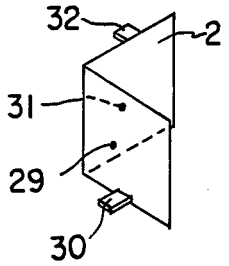
FIG. 3 shows a display element of another embodiment of the invention.

As will be described below, the elements 1 are mounted for rotation on their axis in a manner permitting only one of their four faces, respectively, to be visible to an observer looking at the display side of the display panel 7. An example of cube-like display elements 1 is shown in each of FIGS. 2A and 2B. In FIG. 2A, an element 1 includes opposing translucent or transparent display faces or sides 9, and a pair of opaque faces or opposing display sides 11, for example. Assume that a light source 13, or a plurality of such light sources 13, are mounted behind the elements 1 on the nondisplay side of the display panel 7, for providing a backlighted or luminous display for display panel 7. With an element 1 oriented as shown in FIG. 2A, an observer 15 looking at the element 1 on the display side of the display panel 7 will see the light 17 shining through the element 1 from the light source(s) 13. If the element 1 is rotated 90°, the opaque sides or faces 11 of element 1 will be between the observer 15 and the light source 13, thereby blocking the transmission of light therebetween. Alternatively, a front-lighted or illuminated display for display panel 7 can be obtained utilizing the display elements 1 shown in FIG. 2B, for example. In this embodiment, the elements 1 include a pair of reflective or fluorescent sides 19, and a pair of nonreflective or non-fluorescent opposing sides 21 (assume that appropriate nonreflective or fluorescent, and reflective or non-fluorescent, respectively, material is coated or otherwise placed on the pairs of sides 21 and 19). Assume that a light source 23, or a plurality of such light sources 23, are mounted for transmitting light to the display side of the display panel 7. With the display element 1 oriented as shown in FIG. 2B, substantial light 25 will be reflected from the reflective side 19 of the element 1 to an observer 27 looking at the display side of the display panel 7. If the element 1 is rotated 90°, a nonreflective side or face 21 will be opposite the observer 27, preventing substantial light from being reflected from the light source 23 to the observer 27. If a display panel 7 is made up of a group of elements 1 constructed as shown in FIG. 2A, or as shown in FIG. 2B, the various ones of the elements 1 can be selectively rotated to provide a desired pattern on the display side of the display panel 7 for conveying some desired alphanumeric, graphical, or other similar information to an observer. Note that the display elements 1 can also be shaped in the form of a triangular element 2 as shown in FIG. 3, with the display faces 29 and 31 being at right angles to one another, and one being reflective, with the other nonreflective, for example, whereby the triangular element 1 can be rotated 90° clockwise or counter clockwise for presenting either one of the two operative faces to the front of the display panel 7. The display elements 1 are mounted, as previously described, for rotation on their vertical axis, in this example, in a manner whereupon completion of a given rotation only one of the four display faces of a particular element 1 are visible to an observer looking at the display side of the display panel.

Figure 4:
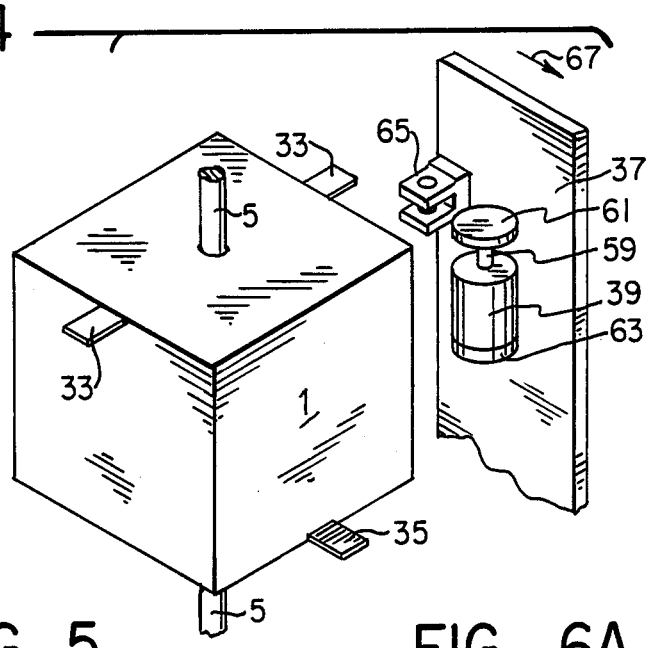
FIG. 4 shows a pictorial diagram of a display element and display element sensor mechanism of one embodiment of the invention.

With reference to FIG. 4, four-faced display elements 1 include two pairs of trigger arms 33, 35, in one embodiment of the invention. As shown in this example, the pair of trigger arms 33 are individually rigidly mounted to a central portion of the upper edges of their respective opposing faces or sides of the associated display element 1. The trigger arms 33, 35, protrude outwardly from their associated display face or side of an element 1. The pair of trigger arms 35 are rigidly mounted to their respective display faces at the central portion of the lower edges of the associated faces of the element 1, and protrude outward therefrom as shown. Note that only one of the trigger arms 35 is shown in FIG. 4, whereby if the element 1 shown is rotated 180°, the display faces or sides of the element 1 not shown would come into view with identically located trigger arms 33, 35. In this example, a carriage 37 (also see FIG. 1) includes a plurality of solenoids 39 rigidly mounted in a column to the carriage 37, as shown, with each one of the solenoids 39 being associated with an individual row of display elements 1. The carriage 37 is rigidly mounted to upper and lower drive belts 40, 41, respectively, as shown. The drive belts 40, 41 are mounted upon upper and lower drive pulleys 43, 45, respectively, and guide pulleys 47 (only one is shown) at their opposite ends. The drive pulleys 43, 45 are rigidly connected to opposite ends of a drive shaft 49. A gear wheel 51 is mounted at the center of the drive shaft 49, for engaging a drive gear 53 driven by a motor 55. Only a portion of the carriage mechanism is shown, in that such mechanisms themselves are well known. The motor 55 can be a stepper motor, an AC motor, a DC motor, and so forth, controllably energized for moving the carriage 37 across the back of the display panel 7 in either direction, as indicated by the arrow 57. Each one of the solenoids 39 includes a movable rod 59, an upper trigger pin 61 rigidly mounted to the top end of the rod 59 and a lower trigger pin 63 rigidly mounted to the bottom end of the rod 59. The trigger pins 61 are relatively small in diameter to prevent interference with the trigger arms 33,35 and/or elements 1. Trigger pins used in an engineering prototype/test model of the invention used ⅛ inch diameter trigger pins 61. During movement of the carriage 37, the location of the solenoids 39 relative to the columns of display elements 1 can be obtained through the use of known position encoders, shaft encoders, and so forth, or by utilizing a stepper motor for the motor 55 and keeping track of the number of the pulses applied to the stepping motor for obtaining positional data for the carriage 37 and solenoids 39. Also, limit switches (not shown) can be incorporated in the apparatus to provide electrical signals indicating that the carriage 37 is at one extreme position or the other.

In one mode of operation of the present invention, as the carriage 37 is driven in one direction behind the columns of elements 1 of the display panel 7, the various solenoids 39 are selectively energized to raise upper trigger pins 61 respectively thereof, or deenergized to drop down the upper trigger pin 61 and lower the lower trigger pins 63, all via movement of the rod 59. The rod 59 is moved upward during energization of a given solenoid 39, and typically is moved downward via an internal return spring during deenergization states of a solenoid 39, for example. As the carriage 37 moves behind a display panel 7 in a given direction, energized solenoids 39 will strike the upper trigger arms 33 of any elements so positioned as the carriage moves by the respective column of such elements 1, causing those elements to rotate 90°. Contrarywise, deenergized ones of the solenoids 39, as they pass by a given column of elements 1, will have their lower trigger pin 63 strike any lower trigger arms 35 of the display elements 1 that are so positioned, causing a rotation of 90° of those particular display elements 1. In this manner, in just one pass of the carriage 37 across the columns of elements 1 of display panel 7, by selectively energizing and deenergizing the solenoids 39 during such movement of the carriage 37, selective ones of the display elements 1 will be rotated, while other of the elements 1 will be left in their original position, for providing a desired pattern of display faces of the display elements 1 on the display side of the display panel 7, for producing some desired pattern for viewing by an observer. As previously described, in this example, the elements 1 are positioned for providing either a combination of reflective or fluorescent, and non-reflective or non-fluorescent surfaces thereof on the front of the display panel 7, or a combination of translucent or transparent faces with opaque faces or sides on the front end of the display panel 7. The pattern of the faces or sides of the display elements so presented can readily be changed to a new pattern by moving the carriage 37 in the opposite direction behind the columns of display elements 1, while again selectively energizing and deenergizing the solenoids 39 as the carriage moves behind the columns of display elements 1.

Through the use of logic circuitry (not shown), the rotation of each one of the columns of display elements 1 can be accomplished for each pass of the carriage 37, or for multiple passes of the carriage 37, or by logic-seeking individual columns of the display elements 1. Detent mechanisms, to be described below, are used to ensure that the display elements that the display elements 1 are detented into stable positions for properly orienting the elements in the matrix of elements 1 after rotation, thereby providing four stable states for each element, each in quadrature. Also, through continuous bidirectional movement of the carriage mechanism 37 and selective energization and deenergization of the solenoids 39, an animated-type display can be provided for the display matrix 7. Note that if the elements 1 each have four unique display faces, three passes of the carriage 37 may be required to establish a desired pattern on the display 7.

With reference to FIG. 3, in another embodiment of the invention, the display elements 2 can be triangularly shaped, with adjacent display faces 29,31 being at right angles to one another, and a trigger arm 30 protruding from the center of the lower edge of one face 29, and another trigger arm 32 protruding from the center of the upper edge of the adjacent display face 31. With triangular display elements 2, in order to establish a desired pattern on the front of the display 7, the carriage 34 may have to be moved first in one direction across the back of the columns of display elements 2, in this example, and then in the other direction, for rotating the elements 2 either 90° clockwise or counter clockwise, for positioning either a display face 29 or a display face 31 at the front of the display panel 7. Contrarywise, the advantage of the four-state elements 1, having two pairs of opposing identical display faces, is that the pattern on the panel 7 can be established by just one pass of the carriage 37 with solenoids 39 across the columns of display elements 1. Also, a disadvantage of a triangular display element 2 is that more elaborate sensing means would be required than that described below for four-state elements 1, to ensure that the triangular elements 2 are not flipped to a position where they could not be flipped back.

With further reference to FIG. 4, the present inventor recognized that many known electromechanical displays do not normally provide for element or character observation by the operator of the front of the display panel. If the operator is not within line of sight of the front of the display panel, he will not be able to observe the operation thereof. Conventional display signs may provide sensors at each element, but such an arrangement would be very complex and expensive. Accordingly, as shown in FIG. 4, another embodiment of the invention includes a plurality of sensors 65, such as photon or optical sensors for example, mounted on the carriage 37, behind the uppermost position of an upper trigger pin 61 with the carriage traveling in the direction of arrow 67, for example. The configuration of the particular sensor 65 is that of an interruptive photon detector such as manufactured by General Electric under part No. GE H20A2, but other types of sensors may also be used. If the carriage 37, moving as described in the direction of arrow 67, passes by a given column of elements 1, and the upper trigger pin 61 is positioned via energization of its associated solenoid 39 for engaging a protruding upper trigger arm 33 of the element 1 being passed, the element 1 will be rotated 90° clockwise. As a result, the trailing sensor 65 will not sense an upper trigger arm 33, thereby signaling via a controller (not shown) to an operator that for that particular element 1, its faces associated with the upper trigger arms 33 are not being displayed. Contrarywise, if the solenoid 39 was not energized during this particular pass of the particular element 1, and the element 1 was positioned as shown before the carriage 37 passed behind it, then as the carriage 37 moved behind the element 1, the sensor 65 would sense the trigger arm 33, signaling back to the display operator that the particular element 1 is displaying a display face associated with the upper trigger arms 33.

A sensing scheme, as discussed above, works well when the display elements 1 have only two unique faces. If the elements 1 have four unique faces, a different triggering/sensing scheme would be required to identify a "home" position. For example, one method would be to have the "home" trigger arm (not shown) longer than the other three, and add a sensor (not shown) on the carriage 37 to detect the longer arm.

The use of only one sensor 65 on the carriage 37 with each solenoid 39 permits the detection of the presence or absence of a trigger arm 33, in this example, in only one direction of movement of the carriage 37. In order to provide bidirectional sensing for movement of the carriage 37, two sensors 65 would have to be mounted on the carriage 37 on opposite sides of each one of the solenoids 39, for example. For the example just given, a sensor 65 would be mounted on either side of the upper trigger pins 61 when in their uppermost positions. Similarly, bidirectional sensing could be provided by locating the sensors 65 on either side of the lower trigger pins 63 for each solenoid 39, with the lower trigger pin 63 in their lowermost positions. Other arrangements for the sensor 65 could also be utilized such as on diagonals relative to the upper and lower trigger pin 61, 63, respectively, and so forth. Different arrangements of the sensors 65 would require alterations of the detection logic circuitry (not shown) for signaling back to the operator the position of the elements 1.

Figure 5:
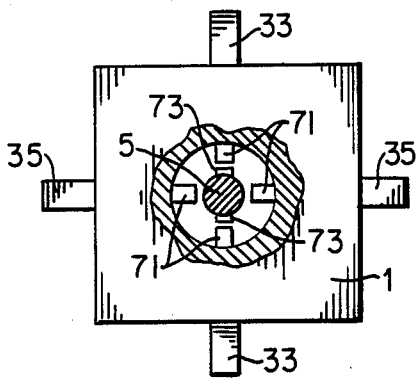
FIG. 5 shows a top view cut-away pictorial diagram of a magnetic detent mechanism of another embodiment of the invention.

As previously mentioned, in one embodiment of the invention each element 1 contains a detent mechanism that provides four stable states for the element 1 relative to its positioning in the display matrix 7, each in quadrature. With reference to FIG. 5, one embodiment of the invention for a magnetic detent mechanism is shown. The display elements 1 are mounted in each column on a stationery rod 5, as previously described, whereby the top and bottom central portions of the surfaces of the elements 1 have appropriate mounting clips (not shown) for both holding the elements 1 vertically in position on the associated rod 5, and permitting rotation of the elements 1 about the rod 5. As further shown, a cylindrical cavity is centrally located within the element 1. The side walls of the cylindrical cavity 69 have four small magnets 71 equidistantly mounted from one another and rigidly to the walls of the cavity 69 in the same horizontal plane, as shown, with like poles facing toward rod 5. Two other permanent magnets 73, having oppositely poled ends relative to the nearest ends of the magnets 71, are mounted directly across from one another to the associated rod 5 in the same horizontal plane as the magnets 71, as shown. The magnets 71 and 73 are positioned as shown, in this example, for detenting the elements 1 into a stable position where their display faces, after a given rotation, are in alignment with the vertical plane associated with the face of the display panel 7. For each stable state of an element 1, the associated magnets 73 will be in alignment with one pair of the associated magnets 71, as shown. If the display element 1 is rotated more than about 45° in either a clockwise or counterclockwise direction, the magnets 73 mounted on the rod 5 will attract the closest ones of the magnets 71 and pull those magnets 71 into alignment with the magnet 73, thereby completing rotation of the display element 1. In this example, such attraction would typically occur when a display element 1 is rotated slightly more than 45° either clockwise or counterclockwise.

A preferred embodiment for providing magnetic detenting of the display elements 1 is shown in FIGS. 6A, 6B, 7, and 8, respectively. As shown, a U-shaped magnet structure 75 includes two disc-like or rectangular magnets 77 magnetized parallel to their thickness, and mounted on each end of a steel strip or back plate 79. Alternatively, the U-shaped magnet structure 75 can be replaced by a U-shaped magnet, for example. The magnet structure 75 is rigidly mounted to a frame member 81 holding the elements 1, in this example, and permitting the magnet structure 75 to represent a fixed portion of the detent assembly. A cross-shaped plate 83 of magnetically soft iron is rigidly mounted on the top of the elements 1, in this example, and represents the rotatable portion of this embodiment of the magnetic detent mechanism. However, the present fixed magnetic structure 75 can readily be interchanged with rotatable cross plate 83 for providing the same detenting action. However, in the preferred embodiment, since the magnets 77 contain the most mass, it is preferred that they be located in the stationery portion of the detent assembly. In this particular example, instead of the stationery rods 5 running through all of the elements 1 in a given column, individual rods 85 are associated with each element 1, for permitting the elements 1 to be rotatably mounted between frame portions 81, as shown. The short rod-like studs or axles 85, in this embodiment, could, for example, be held in place via cup-like bushings 87 pressed into holes in the frame member 81, as shown in FIG. 8.

Figure 6A:
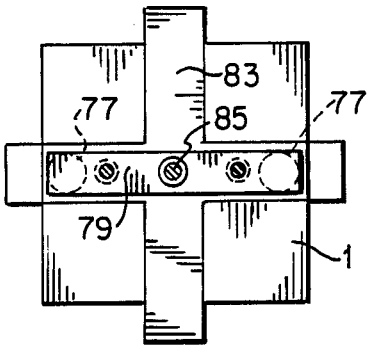
Figure 6B:
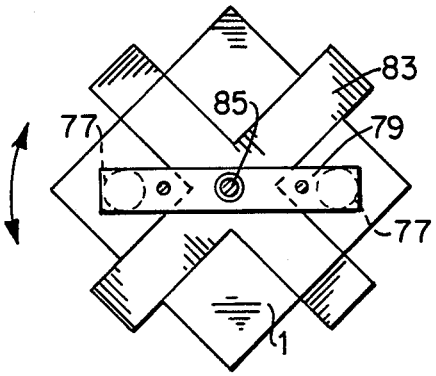
Figure 7:
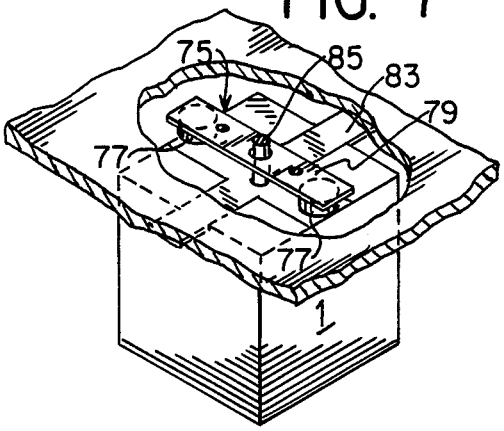

When the four-state display element 1 and its cross-shaped plate 83 are aligned with one of the cross arms of the cross-shaped plate 83 juxtaposed to magnet structure 75, as shown in FIG. 6A, the air gaps between the magnets 77 of structure 75 and the cross plate 83 are at a minimum, causing the magnetic flux to be at a maximum therebetween and concentrated within the air gaps. If the display element 1 is rotated either clockwise or counterclockwise by an external force, for example, by a trigger pin 61 of a solonoid 39 engaging a trigger arm 33 or 35, the poles of the magnet 77 will as a result rotate away from the nearest arm of cross plate 83. As the magnets 77 move away from the arm of the cross plate 83, the air gap therebetween will increasingly widen, creating a dynamic condition. Magnetic flux travels through ferrous materials with a lower reluctance than through air, creating attractive forces between the magnet 77 and the arm of the cross plate 83 for opposing the rotational force on one of the trigger arms 33, 35, thereby opposing rotation of the display element 1. These rotation opposing attractive forces will continue in a dynamically diminishing manner until the rotation of display element 1 causes the initially closest arm of cross-member 83 to the magnet assembly 85 to be rotated more than 45° from the magnet assembly 75. At this rotative point of element 1, a magnetic flux will be established between the magnet 77 and the other arm of cross plate 83 now less than 45° from the magnet structure 75, creating an attractive force therebetween that increasingly assists in completing the rotation of display element 1 through the 90° complete rotation thereof, bringing the magnetic poles of the magnet 77 into alignment with the other arm of the cross plate 83, as shown in FIG. 6A. Note that FIG. 6B shows a display element 1 that has been rotated 45° from its magnetic detent position. Similar to the first embodiment for a magnetic detent system, this second embodiment of a magnetic detent serves to hold its associated display element 1 in alignment in the display matrix 7, for any one of the four alignment states of the display element, for displaying any one of its four faces or sides. As previously described, the magnetic detent system opposes any forces tending to cause rotation of the display element away from the detent position. A second purpose of the magnetic detent system is to assist in completing the last 45° of a 90° rotation of the display element into a new stable or detented state, after the element 1 has been forcibly rotated out of its last stable state, as described.

With reference to FIGS. 9A and 9B, the trigger arms 33 and 35 are shown to consist of substantially rectangular or straight lugs 33, 35. Such a configuration for the trigger arms 33, 35 substantially limits contact between an upper trigger pin 61 as it moves in the direction of arrow 62 past an upper trigger arm 33, as shown in FIG. 9B, to $\theta$ slightly greater than 45° of rotation (in the direction of arrow 64) of an associated element 1. This 45° rotational limit would also occur for the contacting of a lower trigger pin 63 with a lower trigger arm 35. In the preferred embodiment of the invention, it is desirable to provide forceful rotation of a display element 1 by a trigger pin 61 or 63 of more than 45° for ensuring a 90° rotation of the display element 1, as previously described. In other words, it is preferred that a trigger pin 61, 63, remain in contact with a trigger arm 33, 35, respectively, for more than a 45° rotation of a display element 1. After much experimentation, the present inventor discovered that the preferred configuration for the trigger arms 33, 35 is a "Tee" shape, as shown in FIG. 10A for trigger arms 33', 35'. With a trigger pin 61 moving in the direction of arrow 62 first contacting a trigger pin 33', at point A in this example, the element 1 will rotate in the direction of arrow 64. However, when element 1 rotates an angle $\theta$ of 45°, the trigger pin 61 is still in positive contact with trigger arm 33' (see dashed portion depicting element 1 rotated 45°) at point B. Trigger pin 61 continues to move in the direction of arrow 62, further rotating element 1 in the direction of arrow 64. As shown in FIG. 10B, when element 1 has been so rotated to an angle $\theta = 60°$ (see dashed lines), the trigger pin 61 is still in contact with "Tee" shaped trigger arm 33'. Contact therebetween is retained to continue to rotate the display element 1 forcefully for a maximum rotation of more than 60°, depending on the radius of curvature of the surfaces 34 of the trigger arms 33', 35'. The present inventor believes that the limitation on the size of the trigger arms 33', 35' is that the tops 36, thereof, must not extend beyond a circle superscribed around the top of the display element 1. This preferred design of the trigger arms 33', 35' ensures completion of a 90° rotation of a particular display element 1, as provided for herein. Also, trigger pins 61 must be small enough to prevent interference with the elements 1 as the latter rotate. It may be necessary to offset the pins 61 to prevent such interference.

Although particular embodiments of the present invention have been shown and described herein, such illustrative embodiments of the invention are not meant to be limiting, and variations therefrom are to be deemed within the scope and spirit of the appended claims hereto.

What I claim is:

1. A selectively controllable electro-mechanical display apparatus including a matrix of rows and columns of a plurality of individual rotatable multifaced display elements, respectively, each individual display element including trigger arms on immediately adjacent or opposite faces, a carriage, means for controllably moving said carriage back and forth between the extremes of said matrix of display elements proximate the non-display side of said matrix, triggering means mounted on said carriage for selectively engaging preselected ones of the trigger arms of each one of said display elements, as said carriage moves back and forth, to cause rotation of the preselected ones of said display elements, to position desired faces of said elements on the display side of said matrix of elements for displaying a desired pattern, wherein the improvement comprises:

each display element identically having at least two adjacent faces 90° to one another, each face being unique at least relative to its adjacent face, a single trigger arm mounted on and protruding from an opposite edge of each of said two adjacent faces, and protruding away from the axis of rotation of said display element, the opposite edges being perpendicular to the axis of rotation of said display element, whereby when said carriage is moved across said matrix of elements in one direction, selected ones of said elements are rotated 90° via said triggering means engaging the trigger arms thereof, to display different faces thereof, and when said carriage is moved oppositely to said one direction back across said matrix of elements, second selected ones of said elements are rotated 90° in opposite rotation to the first selected ones of said elements, via said triggering means engaging the trigger arms thereof, for displaying different faces of the former, the set-up of a desired pattern of unique faces of said elements on the display side of said matrix of display elements from one pattern to another, requiring from one to three passes of said carriage, depending upon the uniqueness of the faces relative to one another of each display element.

2. The display apparatus of claim 1, further including:

each one of said display elements having four faces, said faces being 90° from and unique relative to an adjacent face, opposite ones of said four faces being identical, with a trigger arm being mounted on and protruding from an edge of each face, whereby when said carriage is moved across said matrix in one pass, all of said first and second selected ones of said elements are rotated 90° in the same rotational direction via said triggering means engaging the trigger arms thereof, for establishing a desired pattern of unique faces of said elements on the display side of said matrix of display elements.

3. The display apparatus of claim 1, further including magnetic detent means for both assisting the rotation of and holding each one of said elements after rotation in a position for displaying a desired face thereof.

4. The display apparatus of claim 2, further including magnetic detent means for both assisting the rotation of and holding each one of said elements after rotation in a position for displaying a desired face thereof.

5. The display apparatus of claims 3 or 4, further including a plurality of non-rotating center shafts upon which each column of elements are mounted for rotation via a centrally located hole in each element, and wherein said magnetic detent means includes:

a plurality of pairs of like poled magnets rigidly mounted on opposite sides of said center shafts within the area enclosed by each center hole of each one of said display elements; and a plurality of sets of four magnets oppositely poled to said pairs of magnets, the magnets of each of said sets being rigidly mounted within and equally spaced from one another on inside walls of the center holes of each one of said display elements, in the same vertical plane as each associated pair of magnets on the associated center shaft, a stable position for each one of said display elements being obtained when two oppositely located ones of the magnets of said sets of magnets are juxtaposed to the associated said pair of magnets, respectively, on the associated center shaft, and whereby upon rotation of a display element away from a stable position of more than about 45°, the magnetic attraction between the nearest ones to one another of said magnets of said pair and set of magnets "pulls" said display element to complete its 90° rotation into a new stable position.

6. The display apparatus of claims 3 or 4, further including a plurality of non-rotating center shafts upon which each column of said display elements are mounted for rotation via a centrally located hole in each element, and wherein said magnetic detent means includes:

a plurality of strips of non-ferromagnetic material, each one of said strips being individually rigidly mounted at its center above a top surface of individual ones of said display elements;

a plurality of cross-shaped plates of magnetically soft iron each individually mounted on the top of one of said display elements, with the ends of the plate centrally located and terminating at a central edge portion of each face, respectively, of said one associated display element; and first and second small relatively thin magnets each magnetized parallel to their thickness, rigidly mounted to an inner surface of each end of said strip, respectively, and facing the top of their associated display element, whereby whenever a strip is aligned with a segment of its associated said cross-shaped plate, the magnet flux between its magnets is closely coupled via the magnetic flux path between said magnets provided by the associated segment of said cross-shaped plate, thereby holding the associated said display element in a stable and detented position, aligning a face thereof with the display side of said matrix of display elements, and whenever the associated said element is rotated with the segments of its said cross-shaped plate more than 45° out of alignment with its associated said strip, the magnets of said strip pull the closest segment thereto of said cross-shaped plate into alignment with said strip, thereby completing rotation of said element into a new display position, and detenting said element into that position.

7. The display apparatus of claims 1 or 2, wherein said trigger arms are "Tee" shaped, and each are mounted on the edge of a face of an associated display element with a top of the "Tee" being away from and parallel to the associated edge, the "Tee" shape providing for greater than 45° rotation of said display element during engagement of said trigger arm with said trigger means.

8. The display apparatus of claims 1 or 2, wherein the trigger arms of each one of said display elements are positioned relative to adjacent faces thereof along top and bottom edge positions, respectively, and said display apparatus further includes sensor means positioned on said carriage for sensing either the presence or absence of a trigger arm protruding from said elements, after said triggering means passes by the area where a trigger arm of said element may be positioned, thereby detecting the face of each of said elements being displayed.

9. The display apparatus of claim 8, wherein said triggering means further includes:

a plurality of solenoid means, each associated with a different row of said display elements, each having a trigger pin selectively positionable to either one of upper or lower positions, for engaging either trigger arm of said opposite edges of adjacent faces, respectively, of said display elements in the associated row, for selectively rotating said display elements.

10. The display apparatus of claim 9, wherein each of said plurality of sensor means further includes first and second sensors mounted on either side of said trigger pin of said solenoid, respectively, in a plane for sensing trigger arms of said display elements of the associated row positioned in the path of travel of the one of said first and second sensors trailing said triggering means relative to the direction of travel of said carriage.

11. A selectively controllable electromechanical display apparatus, comprising:

a matrix of rows and columns of a plurality of rotatable four faced cubical display elements, having first and second pairs of opposing faces, each face being unique relative to its adjacent face, each opposing face being substantially identical, said matrix having a display side and an opposite non-display side;

four trigger arms, one each being centrally mounted along the upper edges of said first pair of opposing faces, and along the lower edges of said second pair of opposing faces, respectively, of each display element;

a carriage;

means for moving said carriage back and forth between the extremes of said matrix of display elements proximate the non-display side of said matrix; and triggering means mounted on said carriage, for selectively engaging preselected ones of the trigger arms of said display elements as said carriage moves in one pass across said matrix, thereby causing 90° rotation of the preselected ones of said display elements, for establishing a desired pattern from the composite of faces of said display elements on the display side of said matrix of display elements.

12. The display apparatus of claim 11, wherein each one of said display elements further includes magnetic detent means for both assisting the completion of rotation of and thereafter holding the associated display element in the desired display position.

13. The display apparatus of claim 11, further including:

each one of said display elements having a first pair of two opposing opaque faces, and a second pair of two opposing either translucent or transparent faces; and light source means on the non-display side of said matrix, whereby whenever any of said display elements are positioned with either a translucent or transparent face on the display and non-display sides of said matrix, respectively, light from said light source means backlights said elements, and whenever any of said display elements are positioned with opaque faces on the display and non-display sides of said matrix, light from said light source means is blocked from shining through the elements to the display side.

14. The display apparatus of claim 11, further including:

each one of said display elements having two opposing non-reflective faces, and two opposing reflective faces, thereby permitting said matrix to be frontlighted from its display side, for providing an illuminated display.

15. The display apparatus of claim 11, further including:

each one of said display elements having two opposing non-fluorescent faces, and two opposing fluorescent faces, thereby permitting said matrix to be frontlighted from its display side, for providing an illuminated display.

* * * * *